US005592265A

United States Patent [19]

Sakuraba et al.

[11] Patent Number: 5,592,265

[45] Date of Patent: Jan. 7, 1997

[54] IMAGE FORMING APPARATUS WITH RESIDUAL TONER REMOVAL

[75] Inventors: Tamotsu Sakuraba; Shinichi Takemoto, both of Toyokawa, Japan

[73] Assignee: Minolta Co., Ltd., Osaka, Japan

[21] Appl. No.: 510,309

[22] Filed: Aug. 2, 1995

[30] Foreign Application Priority Data

Aug. 3, 1994 [JP] Japan ..... 6-182065

[51] Int. Cl.[6] ..... G03G 15/08

[52] U.S. Cl. ..... 399/285; 399/283

[58] Field of Search ..... 355/246, 259, 355/264, 265, 245; 118/653, 652

[56] References Cited

U.S. PATENT DOCUMENTS

| | | | |
|---|---|---|---|
| 4,561,381 | 12/1985 | Kaneko et al. | 118/652 |
| 4,930,438 | 6/1990 | Demizu et al. | 118/651 |
| 5,206,691 | 4/1993 | Mizuno et al. | 355/259 |
| 5,506,372 | 4/1996 | Guth et al. | 118/652 |

FOREIGN PATENT DOCUMENTS

| | | | |
|---|---|---|---|
| 4-56977 | 2/1992 | Japan | 355/264 |

*Primary Examiner*—Joan H. Pendegrass
*Attorney, Agent, or Firm*—Burns, Doane, Swecker & Mathis, LLP

[57] ABSTRACT

An image forming apparatus having a developing device which develops an electrostatic latent image formed on an electrostatic latent image carrier to obtain a visible image. The developing device includes a charge erasing member that erases the electrical charge of residual toner on a developing agent carrier by a charge erasing bias voltage applied thereto. When exposure or not developing is not performed in the image forming apparatus, the charge erasing bias voltage is applied to the charge erasing member. While, during exposure or developing, the charge erasing bias voltage is not applied to the charge erasing member for preventing leaks or discharge phenomenon between the charge erasing member and the developing agent carrier.

20 Claims, 9 Drawing Sheets

IMAGE FORMING APPARATUS WITH RESIDUAL TONER REMOVAL

BACKGROUND OF THE INVENTION

1. Field of the Invention

The present invention relates to an image forming apparatus such as a copying machine or printer that develops an electrostatic latent image formed on an electrostatic latent image carrier to obtain a visible image. More particularly, it relates to an image forming apparatus having one-component developing device that develops an electrostatic latent image employing a one-component developing agent as a developing agent.

2. Description of the Related Arts

Conventionally, an image forming apparatus like a copying machine or printer having a one-component developing device that develops an electrostatic latent image employing a one-component developing agent has been known. Normally, the one-component developing device is provided with a developing agent carrier such as a developing roller, developing sleeve or a developing belt opposite the electrostatic latent image carrier. The developing agent carrier holds the one-component developing agent on its surface and carries out the developing process by transferring developing agent from a developing agent storage portion to the opposing portion of the electrostatic latent image carrier (referred to "developing region" hereinafter). After developing, residual toner attached to the developing sleeve is returned to the developing agent storage portion by the rotation of the developing sleeve.

The toner returned to the storage portion is removed from the developing sleeve although, one portion of highly charged toner remains on the surface of the developing sleeve. This remaining toner forms a micro-electric field between the itself and the developing sleeve. This micro-electric field draws subsequently supplied toner to the top of the developing sleeve.

However, when a low humidity environment causes the toner to more flow, the charge amount of the toner also increase thus the toner is not removed from the developing sleeve with a tendency for the highly charged toner accumulating on the developing sleeve to increase. Therefore, the amount of toner attracted to the developing sleeve increases and the amount of toner adhering to the sleeve becoming impossible to restrict even by the restricting blade resulting in an abnormal amount of toner being transferred to the electrostatic latent image carrier in the developing region. If an abnormal amount of toner is transferred to the electrostatic latent image carrier in the developing region, problems such as the non-image portion being developed, memory phenomenon in which toner remaining on the developing sleeve develops again, and toner scattering around the periphery of the sleeve will occur.

Furthermore, this results in the toner accumulating on the developing sleeve repeatedly receiving stress from the restricting blade thus adhering to the developing sleeve. This type of phenomenon is called "filming". Filming is the cause of degrading image quality.

Further, when the toner on the developing sleeve receives stress, toner become to have a small diameter or fluid silica contained in the toner is peeled. As a result, reproducibility of black portions of the image is poor.

Even further, when the toner accumulating on the developing sleeve increases, toner newly supplied to the developing sleeve is not only charged by the restricting blade but is also charged by the friction of the other toner. Therefore, the charging polarity of the toner opposite that of the regular charging polarity increases resulting in deterioration of image quality.

In one such disclosure of a developing device in U.S. Pat. No. 4,930,438, a charge erasing brush is provided to weaken the electrostatic adhesion force of the residual toner on the developing sleeve. A power supply with a voltage identical to the developing bias voltage applied to the developing sleeve applies a charge erasing bias voltage to this charge erasing brush. The charge erasing brush then erases unnecessary accumulating charge from the residual toner using this applied voltage to weaken the electrostatic adhesion force of the residual toner on the developing sleeve.

However, when a voltage identical to the developing bias voltage is applied to the charge erasing brush, it becomes impossible to erase the charge of a voltage lower than the developing bias voltage even if an accumulated charge higher than the developing bias voltage can be removed.

SUMMARY OF THE INVENTION

The object of this invention is to provide an image forming apparatus that achieves an excellent developing to obtain an excellent image.

Another object of this invention is to provide an image forming apparatus that achieves an excellent developing to obtain an excellent image by erasing the charge of residual toner held on the developing agent carrier after developing making it easy to remove residual toner from the developing agent carrier.

Another object of this invention is to provide an image forming apparatus that achieves an excellent developing to obtain an excellent image by erasing the charge of residual toner as desired in a developing device and avoiding problems such as memory phenomenon or abnormal toner adhesion due to insufficient toner charge erasure and poor conditions such as occurrences of electrical discharge.

These and other objects, advantages and features of the invention will become apparent from the following description thereof taken in conjunction with the accompanying drawings which illustrate specific embodiments of the invention.

BRIEF DESCRIPTION OF THE DRAWINGS

In the following description, like parts are designated by like reference numbers throughout the several drawings.

DESCRIPTION OF THE PREFERRED EMBODIMENTS

Figure 1:
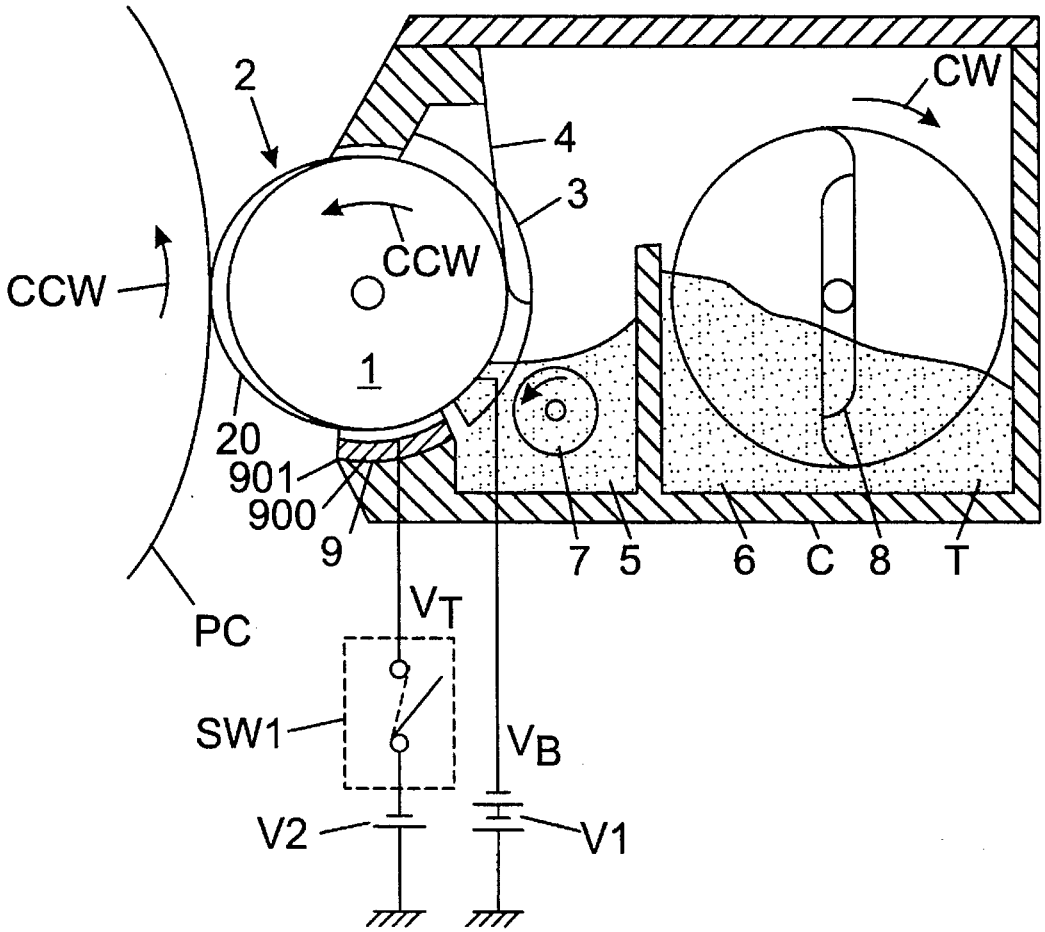
FIG. 1 is an outline cross-sectional view of the developing device portion according to one preferred embodiment of the present invention.

Referring now to the drawings, an image forming apparatus according to one preferred embodiment of the present invention will be explained.

In the developing device shown in FIG. 1, numerical 1 designates a drive roller, numerical 2 designates a bendable developing sleeve fit on the outside of the drive roller 1, numerical 3 designates a pair of pressure guides which press both edges of the developing sleeve 2, numerical 4 designates a toner restricting blade making contact with the developing sleeve 2, numerical 5 designates a buffer chamber, numerical 6 designates a toner supply chamber, numerical 7 designates a toner supply member arranged in the buffer chamber 5, numerical 8 designates a toner stirring member arranged in the toner supply chamber 6, and T designates the toner used.

The inside diameter of the developing sleeve 2 which is the developing agent carrier is somewhat larger than the outside diameter of the drive roller 1. A loosening portion 20 achieved by the pressure guides 3 pressing the developing sleeve 2 loosely makes contact with the surface of a photoreceptor drum PC which is the electrostatic latent image carrier. The drive roller 1 and toner supply member 7 are rotated in the counterclockwise direction (CCW direction in the figure) by a drive motor (not shown in figure). The developing sleeve 2 is rotated in the counterclockwise direction (CCW direction in the figure) by the frictional force of the drive rotation of the drive roller 1. Further, the toner stirring member 8 is rotated in the clockwise direction (CW direction in the figure) by the drive motor (not shown in figure). Negatively charged polyester type toner is then used for the toner T although, if necessary, another toner can be used.

In the developing device shown in FIG. 1, the toner T is transferred to the buffer chamber 5 from the toner supply chamber 6 by the rotation of the toner stirring member 8. The toner T transferred to the buffer chamber 5 is supplied to the surface of the developing sleeve 2 in order at developing agent supply regions by the rotation of the toner supply member 7.

The toner T supplied to the surface of the developing sleeve 2 is transferred by the rotation of the developing sleeve 2 passing between the toner restricting blade 4 and the developing sleeve 2. During this time, the toner T is triboelectrically charged by the pressure of the toner restricting blade 4 forming a thin film at a specified thickness. The toner T which formed a thin film at a specified thickness is held on the surface of the developing sleeve 2, transferred to the developing regions confront the photoreceptor drum PC where it is used to develop the electrostatic latent image.

Furthermore, in the developing device shown in FIG. 1, numerical 9 designates a toner charge erasing member that serves as a lower seal member to prevent toner from leaking outside of the buffer chamber 5. The charge erasing member 9 is supported at the developing device casing C. The charge erasing member 9 passes transversely over the surface movement direction (CCW direction in the figure) of the developing sleeve 2 making contact with the surface of the sleeve 2 either through the toner layer or directly. The charge erasing member 9 is located at a region extending to the toner restricting blade 4 from the downstream side from the developing region in the rotation direction of the developing sleeve 2. Residual toner T from among the toner T used for developing in the developing region passes between the charge erasing member 9 and developing sleeve 2 to return to the buffer chamber 5.

The surface of the charge erasing member 9 makes contact with at least the developing sleeve 2 and is formed by a material having the same polarity as the toner T. Further, it is preferable for this material to have same polarity as the toner T in view of the triboelectric series. Also, a material with good conductivity dispersed throughout is used for the material forming the charge erasing member 9. Thus, the charge erasing member 9 includes a main body 900 and a tape 901 which is adhered to the surface of the main body 900. The main body 900 is formed with a soft elastic material such as polyurethane foam. The tape 901 formed with polytetrafluoroethylene resin and contains carbon black dispersed throughout allowing conductivity. The surface roughness (Rz) of the tape 901 is approximately 5 μm with this roughness making contact with the developing sleeve 2. Further, in order to increase the charge erasure effectiveness using friction, a surface roughness (Rz) of 5 μm of the polytetrafluoroethylene tape is set to a roughness that is rougher than the ordinary surface roughness (Rz) of 2 μm of polytetrafluoroethylene tape. The surface roughness (Rz) of the tape 901 can be larger than 5 μm although, if it is too rough, noise appearing as streaks will occur on the developing sleeve 2 thus, the roughness Rz should be smaller than approximately 20 μm.

In the developing device shown in FIG. 1, a direct current power supply V1 used for the developing bias voltage is connected to the developing sleeve 2 and applies developing bias voltage $V_B$ to the developing sleeve 2. Further, a direct current power supply V2 used for the toner charge erasing bias voltage is constructed to be connected to a tape 901 portion of the charge erasing member 9 through a switch SW1 with toner charge erasing bias voltage $V_T$ being applied to the charge erasing member 9. In this example, the developing bias voltage $V_B$ applied to the developing sleeve 2 from the power supply V1 is −300 V and the toner charge erasing bias voltage $V_T$ applied to the charge erasing member 9 from the power supply V2 is −200 V.

The toner charge erasing bias voltage $V_T$ applied to the charge erasing member 9 draws the toner T to the charge erasing member 9 when passing through the charge erasing member 9. The electrical charge is removed from the toner T attracted to the charge erasing member 9 by contact and friction with the charge erasing member 9. When the toner T returns to the buffer chamber 5, the charge erasing action of the charge erasing member 9 makes it easy to remove the toner from the surface of the developing sleeve 2.

Figure 2:
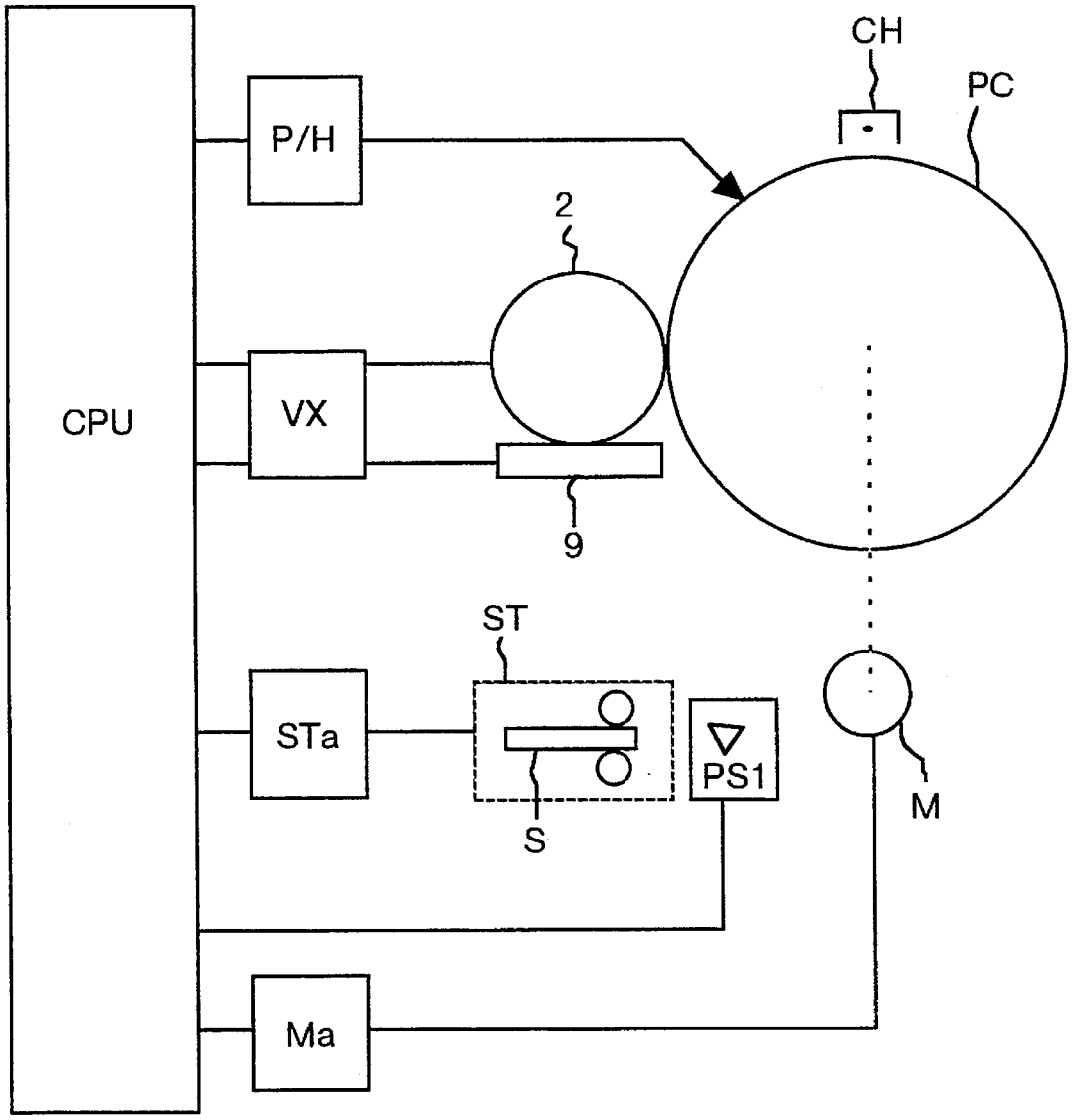
FIG. 2 is a control circuit diagram of the printer of this invention.

FIG. 2 is a control circuit for printer which employs the developing device as shown in FIG. 1.

By this control circuit, the developing device as shown FIG. 1 is controlled with a photoreceptor drum PC and a print head portion P/H, etc. The image forming means comprises a charging device CH and the printer head portion P/H composed of a laser diode LD. The laser diode LD illuminates laser light to the top of the photoreceptor drum PC which is charged by the charging device CH forming a latent image on the photoreceptor drum PC.

Further, a main motor M in FIG. 2 drives the photoreceptor drum PC to rotate based on instructions from a drive circuit Ma. The drive circuit Ma is controlled by a control portion CPU.

A sheet feeder portion ST feeds transfer sheets S based on instructions of the sheet feeder control circuit STa. The sheet feeder control circuit STa is also controlled by the control portion CPU.

A paper sensor PS1 detects the arrival of the leading edge of the transfer sheet S fed from the sheet feeder portion ST and the passage of the transfer sheet S. The detection signal of the paper sensor PS1 is input to the control portion CPU.

A high-voltage power supply VX includes a power supply V1 that applies developing bias voltage $V_B$ to the developing sleeve 2, a direct current power supply V2 that applies toner charge erasing bias voltage $V_T$ to the charge erasing member 9 and a switch SW1. These are all controlled by the control portion CPU also.

The control portion CPU is comprised of mainly a microcomputer.

An example of a printer is shown here using an image forming apparatus. This invention can be applied to an image forming apparatus like a copying machine or facsimile that develops an electrostatic latent image formed on an electrostatic latent image carrier to obtain a visible image and is particularly effective for an image forming apparatus of electronic photographs. Moreover, the image forming means used in the image forming apparatus are not limited to including a laser diode but on the condition that the means forms electrostatic latent image on an electrostatic latent image carrier. For example, electrostatic latent image could be created on electrostatic latent image carrier by imagewise optical exposure, by LED light emitting exposure or by imagewise ion deposition.

Figure 3:
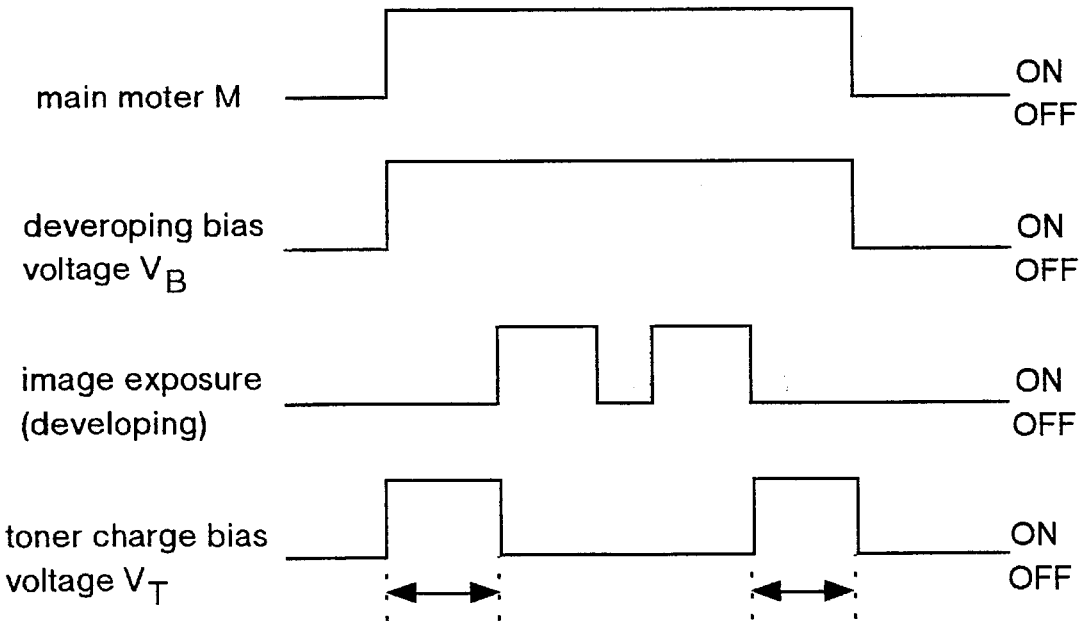
FIG. 3 is a timing chart showing the timing of the application of the developing bias voltage and charge erasing bias voltage of the printer of the present invention.

FIG. 3 is a timing chart of the operation of the main motor M, the application of the developing bias voltage $V_B$ to the developing sleeve 2 in the developing device, image exposure using the printer head portion P/H and the developing operation of the developing device along with it, and the operation of the application of the toner charge erasing bias voltage $V_T$ to the toner charge erasing member 9 in the developing device based on the control of the control circuit CPU.

Figure 4:
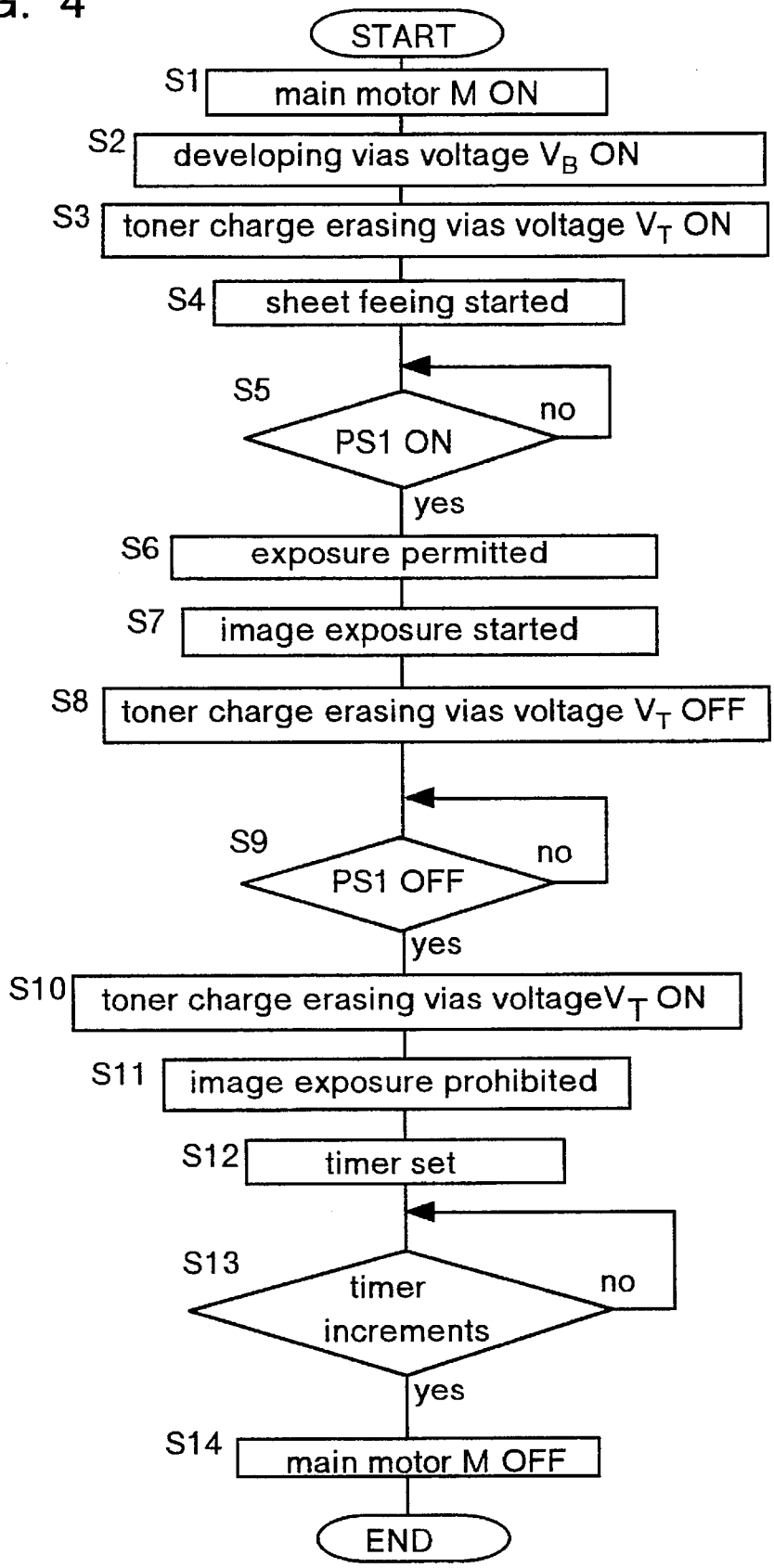
FIG. 4 is a flowchart showing an outline of the operation of a printer of the present invention.

FIG. 4 is a flowchart of a program written in the control circuit CPU to execute the timing chart shown in FIG. 3.

In the flowchart of FIG. 4, when the print starts, initially the main motor M turns ON in step S1. Simultaneously when the main motor M turns ON, the developing bias voltage $V_B$ is applied in step S2 and then in step S3, switch SW1 closes and the toner charge erasing bias voltage $V_T$ is applied to the toner charge erasing member 9.

Next, in step S4, the transfer sheet S is started to be fed from the sheet feeder portion ST and in step S5, the apparatus waits until the leading edge of the transfer sheet S is detected by the paper sensor PS1. When the leading edge of the transfer sheet S is detected by the paper sensor PS1, the flow moves to step S6 permitting exposure by the printer head portion P/H. When image exposure starts in step S7, switch SW1 is opened in step S8 and the toner charge erasing bias voltage $V_T$ is turned OFF.

Then, in step S9, when the passage of one transfer sheet S to form one image is detected or when the passage of a plurality of transfer sheets S to form a plurality of images is detected by means of paper sensor PS1, switch SW1 is closed again in step S10 and the application of the toner charge erasing bias voltage $V_T$ is initiated. At the same time the application of the toner charge erasing bias voltage $V_T$ is initiated, the image exposure is prohibited in step S11. Next, in step S12, the timer is set and when the timer increments in step S13, the main motor M is turned OFF in step S14. Further, along with the main motor M being turned OFF, the developing bias voltage $V_B$ and toner charge erasing bias voltage $V_T$ are also turned OFF.

Therefore, in the developing device of this invention, during non-developing, that is, when before the developing operation for the first image and after the developing operation for the last image, said switch SW1 is closed and then the toner charge erasing bias voltage $V_T$ is applied to the charge erasing member 9. While the toner charge erasing bias voltage $V_T$ is being applied, the toner T on the developing sleeve 2 passing through the portion opposite the charge erasing member 9 is attracted towards the electrical field of the charge erasing member 9 by the function of the electric potential difference between the toner charge erasing bias voltage $V_T$ and the developing bias voltage $V_B$. The toner T attracted to the charge erasing member 9 releases the charge by the friction between itself and the charge erasing member 9 thus erasing the charge of the toner T. Thereby, the toner T from which the charge is erased loses its image force between itself and the developing sleeve 2 and when the toner T approaches the toner restricting blade 4 again, it will be separated from the surface of the developing sleeve 2 to the toner supply side.

During developing, the surface portion where the toner is consumed on the developing sleeve 2 is opposite the charge erasing member 9. When the surface portion where the toner is consumed by the developing sleeve 2 by the developing is opposite the charge erasing member 9, the surface portion of the developing sleeve 2 makes contact with the charge erasing member 9 directly or through the small amount of toner remaining on the surface of the developing sleeve 2. If there is an electrical potential difference between the developing sleeve 2 and the charge erasing member 9 over the fixed value when this occurs, leaks or discharge phenomenon will occur between the developing sleeve 2 and the charge erasing member 9 resulting in poor influences such as damage to the charge erasing member 9 by fusing. To prevent this from occurring in this invention, switch SW1 is opened during image exposure and developing which both consume toner to float the charge erasing member 9. By this action, the application of the toner charge erasing bias voltage $V_T$ to the charge erasing member 9 is not carried out. Therefore, the electrical potential of the charge erasing member 9 is the same potential as either the surface potential of the developing sleeve 2 or the surface potential of the small layer of toner usually remaining on the surface of the developing sleeve 2. Consequently, discharge current between the developing sleeve 2 and the charge erasing member 9 does not flow and there is no danger of damage to the charge erasing member 9. Thus allowing safe and reliable toner erasure over long periods of time.

Further, in the timing chart shown in FIG. 3, when forming a plurality of images, the application of the toner charge erasing bias voltage $V_T$ to the charge erasing member 9 is not carried out during the non-image area when after the finish of one developing before the start of the subsequent developing or when after the finish of one exposure before the start of the subsequent exposure. However, the charge erasing bias voltage $V_T$ can be applied during the non-image area.

Figure 5:
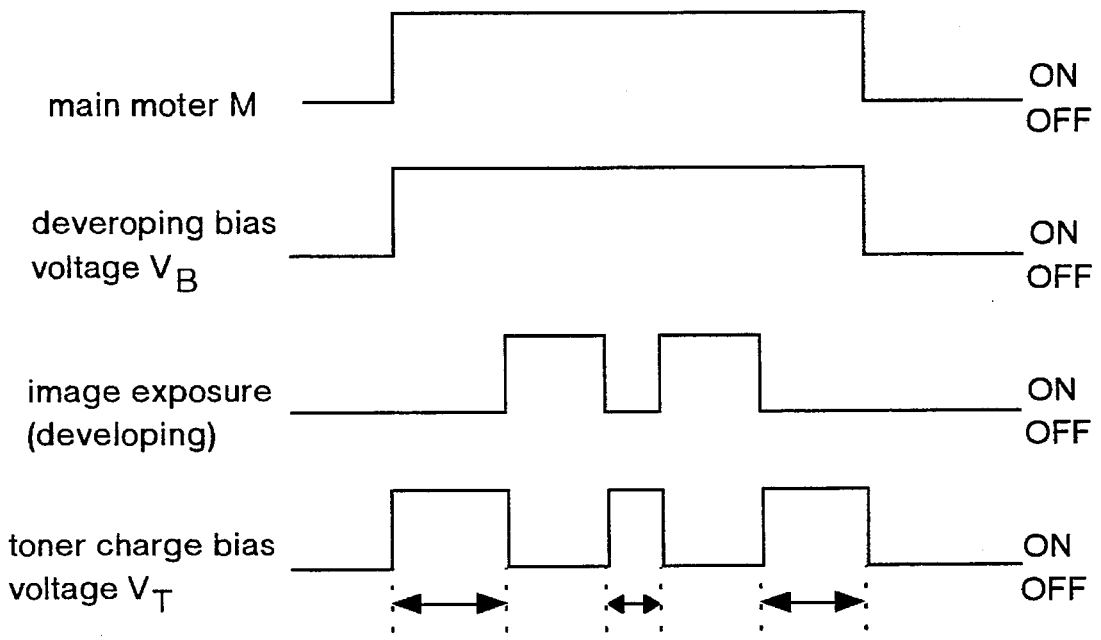
FIG. 5 is a timing chart showing the timing of the application of the developing bias voltage and charge erasing bias voltage of another example of the present invention.

FIG. 5 is a timing chart showing a state when the charge erasing bias voltage $V_T$ is applied in the non-image area. The timing chart of FIG. 5 shows the operation of the main motor M, the application of the developing bias voltage $V_B$ to the developing sleeve 2 of the developing device, image exposure using the printer head portion P/H and the developing operation of the developing device along with it, and the operation of the application of the toner charge erasing bias voltage $V_T$ to the charge erasing member 9 of the developing device based on the control of the control circuit CPU.

Figure 6:
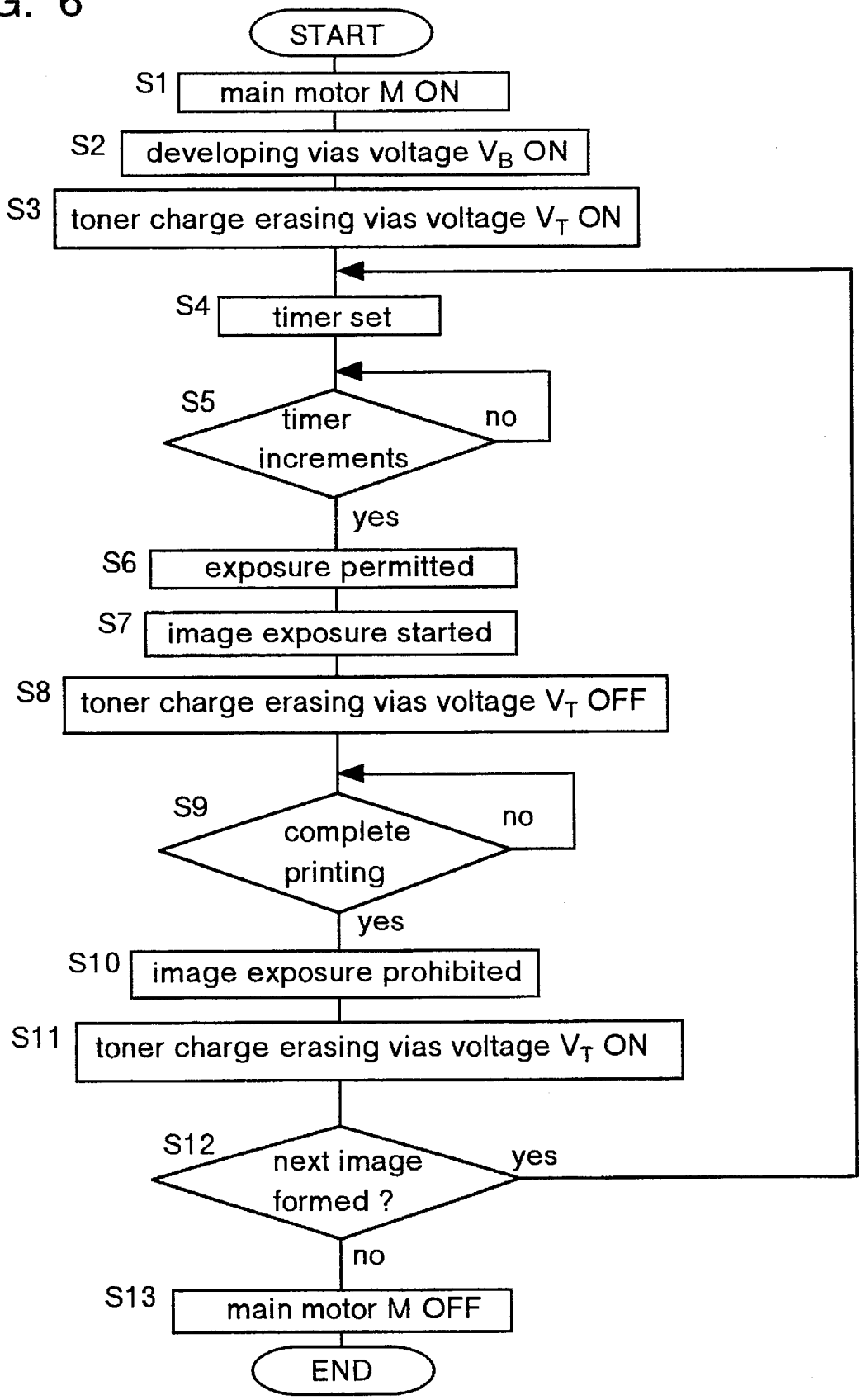
FIG. 6 is a flowchart showing an outline of the operation of a printer of another example of the present invention.

FIG. 6 is a flowchart of a program written in the control circuit CPU to execute the timing chart shown in FIG. 5.

In the flowchart of FIG. 6, when the print starts, initially the main motor M turns ON in step S1. Simultaneously when the main motor M turns ON, the developing bias voltage $V_B$ is applied in step S2 and then in step S3, switch SW1 closes and the toner charge erasing bias voltage $V_T$ is applied to the charge erasing member 9.

Next, when the leading edge of the transfer sheet S fed from the sheet feeder portion ST is detected by the paper sensor PS1, the timer is set in step S4. When the timer increment is confirmed in step S5, the flow moves to step S6 permitting exposure by the printer head portion P/H and then the exposure is started in step S7. When image exposure starts in step S7, switch SW1 is opened in step S8 and the toner charge erasing bias voltage $V_T$ is turned OFF.

Then, in step S9 the process waits for one image to complete printing and in step S10, exposure is prohibited along with switch SW1 closing in step S11 and the application of the toner charge erasing bias voltage $V_T$ being started. Next, in step S12 a judgment is made on whether or not the next image forms subsequently and if the result is a YES, the flow returns to step S4 and the timer is set. If the result is a NO, the flow continues to step S13 and the main motor M is turned OFF. Simultaneously, the developing bias voltage $V_B$ and the toner charge erasing bias voltage $V_T$ turned OFF as well.

Therefore, because the charge is erased from the toner during non-image area in this control, poor conditions such as toner abnormally adhering to the developing sleeve 2 can be reliably prevented even more. Also, since the toner charge erasing bias voltage $V_T$ turns OFF during exposure and developing, discharge current between the developing sleeve 2 and the charge erasing member 9 does not flow and there is no danger of damage to the charge erasing member 9. Thus allowing even safer and more reliable toner erasure over long periods of time.

Figure 7:
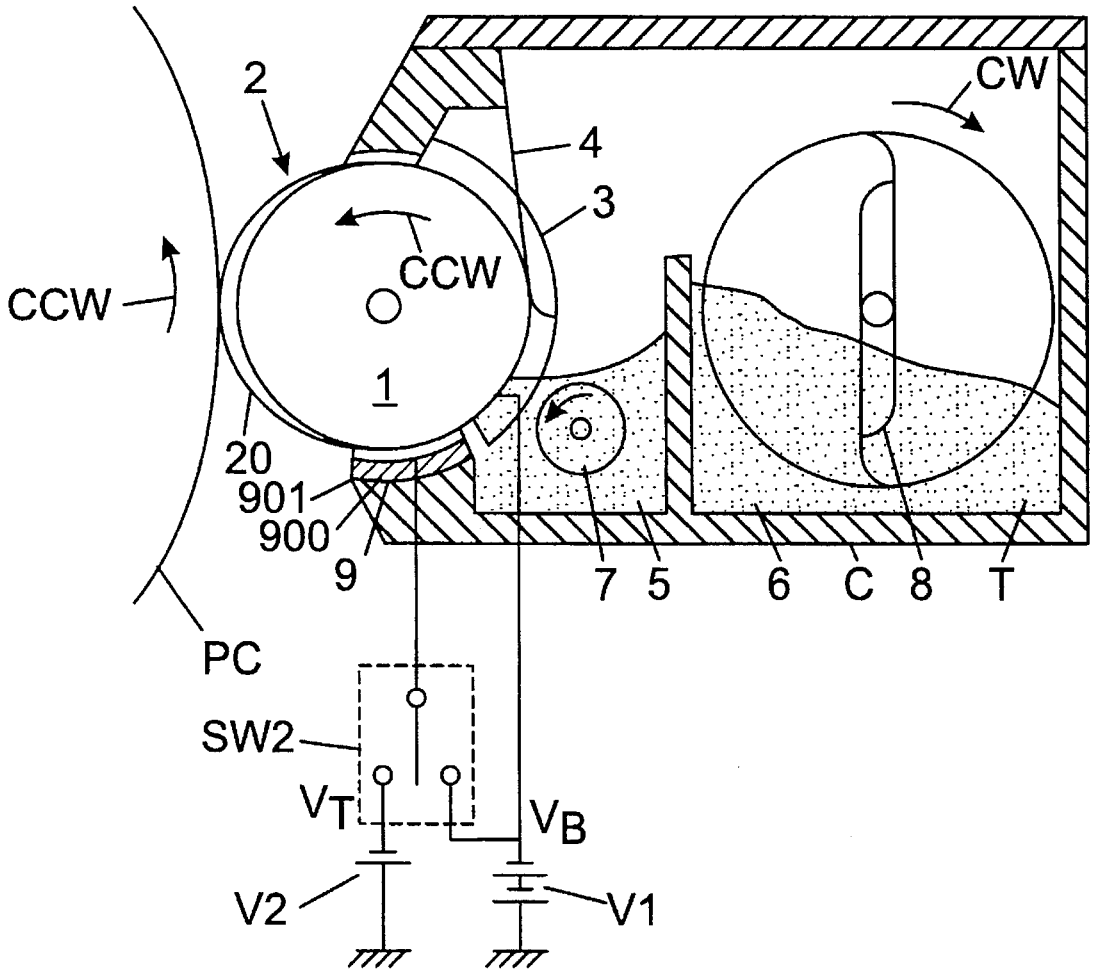
FIG. 7 is an outline cross-sectional view of the developing device portion according to another preferred embodiment of the present invention.
Figure 8:
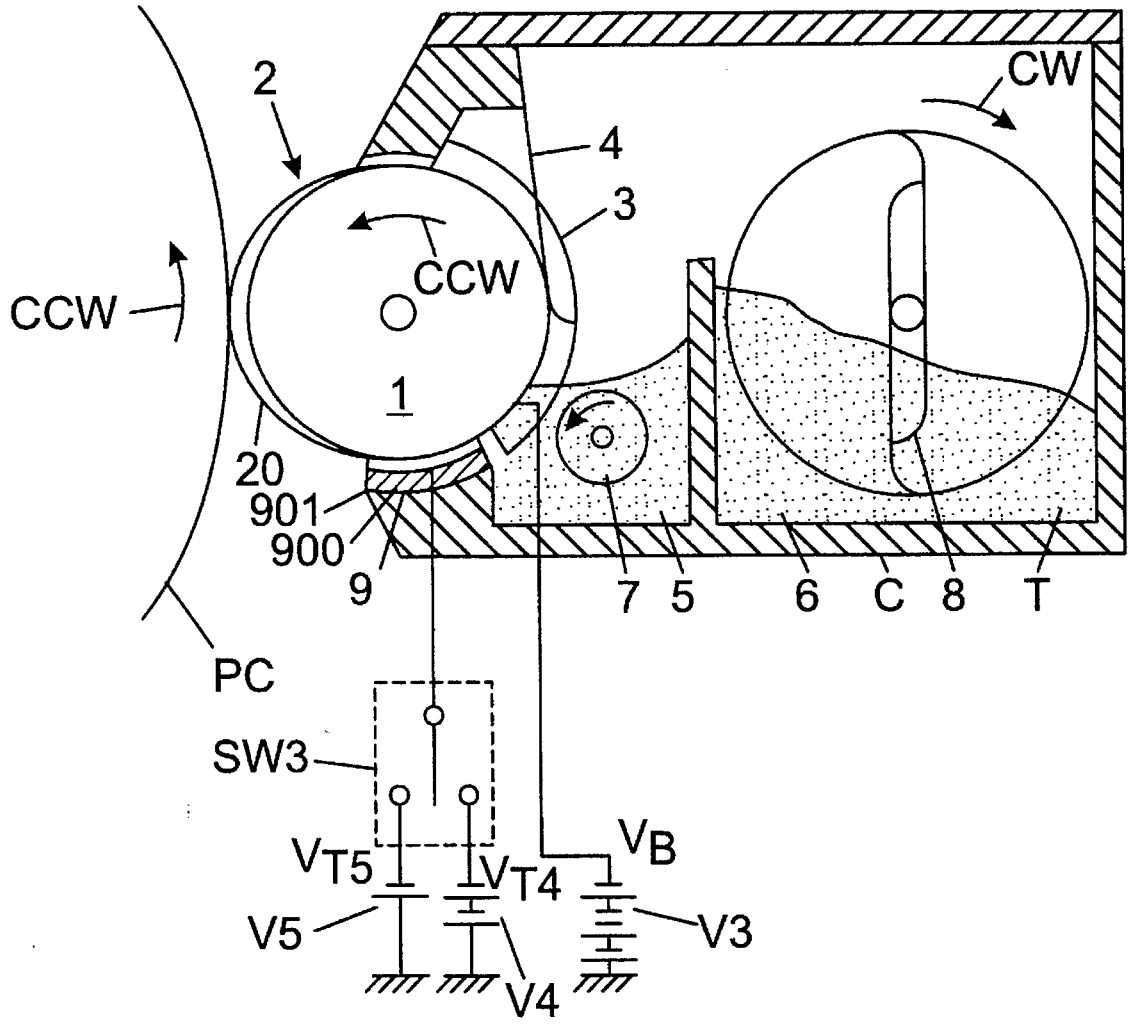
FIG. 8 is an outline cross-sectional view of the developing device portion according to another preferred embodiment of the present invention.
Figure 9:
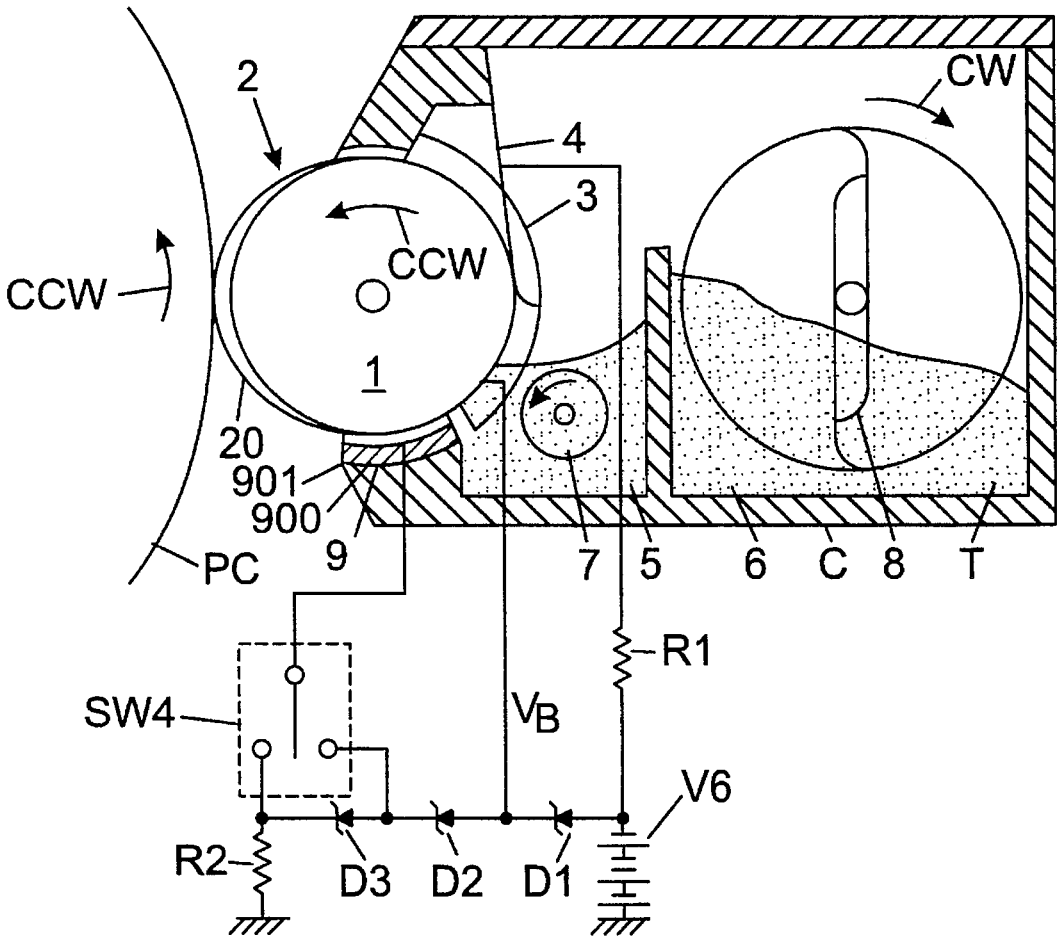
FIG. 9 is an outline cross-sectional view of the developing device portion according to another preferred embodiment of the present invention.

Next, another example of construction of this invention is described using FIG. 7, FIG. 8 and FIG. 9. The fundamental construction of the developing device shown in each of these figures is similar to the developing device shown in FIG. 1 and parts identical to those of the developing device shown in FIG. 1 are designated by like numbers. Further, the developing devices in each of these figures is incorporated in a printer like the developing device of FIG. 1 and based on the flowcharts shown in FIG. 4 or FIG. 6, they operate using operation timing like the timing charts shown in FIG. 3 or FIG. 5.

In the developing device of FIG. 7, a direct current power supply V1 used for the developing bias voltage and a direct current power supply V2 used for the toner charge erasing bias voltage are both provided and can be connected to the charge erasing member 9 through the switch SW2. Using the switching operation of the switch SW2, the bias voltage power supply connected to the charge erasing member 9 can be switched between the direct current power supply V1 used for the developing bias voltage and the direct current power supply V2 used for the toner charge erasing bias voltage. The switching operation of the switch SW2 is performed like the timing of the switching operation of the switch SW1 in the developing device of FIG. 1. Therefore, during non-developing, the toner charge erasing bias voltage $V_T$ is applied to the charge erasing member 9 and during developing, the developing bias voltage $V_B$ is applied to the charge erasing member 9. When the developing bias voltage $V_B$ is applied to the charge erasing member 9, the developing sleeve 2 and the charge erasing member 9 reach the same electrical potential thus making it possible to prevent leaks and discharge phenomenon between the developing sleeve 2 and the charge erasing member 9.

In the developing device of FIG. 8, a direct current power supply V3 used for the developing bias voltage is connected to the developing sleeve 2 and applies developing bias voltage $V_B$ to the sleeve. Conversely, using the switching operation of the switch SW3, the bias power supply connected to the charge erasing member 9 can be switched between direct current power supply V4 or V5. The switching operation of the switch SW3 is performed like the timing of the switching operation of the switch SW1 in the developing device of FIG. 1. Therefore, during non-developing, the toner charge erasing bias voltage $V_T$5 is applied to the charge erasing member 9 and during developing, the toner charge erasing bias voltage $V_T$4 is applied to the charge erasing member 9. Toner charge erasing bias voltage $V_T$5 and toner charge erasing bias voltage $V_T$4 both erase the charge on the developing sleeve 2 although the voltage value of toner charge erasing bias voltage $V_T$4 is set at a higher value than the voltage value of toner charge erasing bias voltage $V_T$5. Consequently, the electrical potential difference of the bias voltage applied to the developing bias voltage $V_B$ and the charge erasing member 9 becomes smaller during developing than during non-developing. Further, the toner charge erasing bias voltage $V_T$4 has a fixed electrical potential difference relative to the developing bias voltage $V_B$ in order to obtain the charge erasing effect during developing as well. This electrical potential difference is set within a range in which leaks or discharge phenomenon do not occur between the developing sleeve 2 and the charge erasing member 9. The toner charge erasing effect increases as the electrical potential difference of the developing sleeve and charge erasing member rises and if it exceeds a fixed value, leaks or discharge phenomenon will occur. The electrical potential difference at which leaks will begin during developing depends on the conditions although generally it is approximately 150 V. Therefore, direct current power supply V5 is chosen to set the charge erasing bias voltage $V_T$4 to 150 V or less so leaks or discharge phenomenon do not occur between the developing sleeve 2 and the charge erasing member 9. Therefore, the developing device of FIG. 8 can ensure the necessary charge erasing effect during both developing and non-developing thus making it possible to prevent leaks and discharge phenomenon between the developing sleeve 2 and the charge erasing member 9.

The developing device of FIG. 9 applies a bias voltage to the developing sleeve 2 and the charge erasing member 9 utilizing a direct current power supply V6 common to both. The direct current power supply V6 is connected to the toner restricting blade 4 via a resistor R1 (50MΩ). The direct current power supply V6 is further connected to developing sleeve 2 via a first zener diode D1. Switch SW4 is also connected to the charge erasing member 9. The switch SW4 changes the connection of the direct current power supply V6 to the toner charge erasing member 9 through either the first zener diode D1 and second zener diode D2 or through the first zener diode D1, second zener diode D2 and third zener diode D3. Further, for any of these cases, the direct current power supply V6 is grounded through the first zener diode D1, second zener diode D2, third zener diode D3 and a protection circuit R2 (50MΩ).

In the developing device of FIG. 9, the direct current power supply V6 supplies a direct current at −550 V. A restricting bias voltage Vc of slightly less than −550 V is applied to the restricting blade 4 via the resistor R1. The developing bias voltage $V_B$ applied to the developing sleeve 2 is set to −300 V by a voltage drop (250 V) using the first zener diode D1. The toner charge erasing bias voltage $V_T$ applied to the toner charge erasing member 9 can be set at −200 V by the first zener diode D1 and the second zener diode D2, and can be set at −100 V by the first zener diode D1, the second zener diode D2 and the third zener diode D3.

The switching operation of the switch SW4 is performed like the timing of the switching operation of the switch SW1 in the developing device of FIG. 1. Therefore, during developing, −200 V, which is set by the voltage drop (100 V) of the first zener diode D1 and the second zener diode D2, is applied to the charge erasing member 9 and during non-developing, a voltage of −100 V, which is set by the voltage drop (100 V) of the first zener diode D1, second zener diode D2 and third zener diode D3, is applied to the charge erasing member 9. Consequently, the electrical potential difference of the bias voltage applied to the developing bias voltage $V_B$ and the charge erasing member 9 becomes smaller during developing than during non-developing. Further, the charge erasing bias voltage has a fixed electrical potential difference relative to the developing bias voltage $V_B$ in order to obtain the charge erasing effect during developing as well. This electrical potential difference is set within a range in which leaks or discharge phenomenon do not occur between the developing sleeve 2 and the charge erasing member 9. The direct current power supply V6 and each zener diode set the charge erasing bias voltage at a value lower than 150 V so leaks or discharge phenomenon do not occur between the developing sleeve 2 and the charge erasing member 9. Therefore, the developing device of FIG. 9 can ensure the necessary charge erasing effect during both developing and non-developing thus making it possible to prevent leaks and discharge phenomenon between the developing sleeve 2 and the charge erasing member 9.

Furthermore, in the developing device of FIG. 9, even if the developing bias voltage $V_B$ is adjusted to adjust the image density, the electrical potential difference between the toner charge erasing bias voltage applied to the charge erasing member 9 and the developing bias voltage $V_B$ is held at an essentially fixed value by the zener diodes. Therefore, toner charge erasing can be carried out as desired without this electrical potential difference growing too small or too large. The developing device of FIG. 9 can prevent insufficient charge erasure of the toner resulting in memory phenomenon or abnormal toner adhesion due to the electric potential difference between the toner charge erasing bias voltage $V_T$ and the developing bias voltage $V_B$ becoming too small, while the developing device of FIG. 9 can also prevent as gaseous discharge resulting in drops in the effectiveness of charge erasure or damage to the charge erasing member due to the electric potential difference between the toner charge erasing bias voltage $V_T$ and the developing bias voltage $V_B$ becoming too large. Furthermore, because the developing device of FIG. 9 can maintain a high charge erasure effectiveness by maintaining the electric potential difference between the toner charge erasing bias voltage and the developing bias voltage $V_B$ at a constant level, the replaceability of the toner is improved thus preventing toner deterioration and filming. In this way, excellent developing can be achieved thus an excellent image obtained by using the developing device of FIG. 9.

Additionally, the developing device of FIG. 9 maintains an essentially constant electric potential difference between the restricting bias voltage applied to the restricting blade 4 and the developing bias voltage $V_B$ applied to the developing sleeve 2 using the zener diode D1. Consequently, a constant relationship is maintained between the electric potential difference between the restricting bias voltage, the developing bias voltage $V_B$ and the toner charge erasing bias voltage by each zener diode. This is how the developing device of FIG. 9 can achieve more excellent developing.

Moreover, in this example the construction is such that a fixed charge erasing bias voltage can be applied to the charge erasing member 9 during developing using the zener diode D3. However, the construction may be such that the charge erasing member 9 can be grounded during developing.

The switches SW1, SW2, SW3 and SW4 which switch the bias potential of each developing device in FIG. 1, FIG. 7, FIG. 8 and FIG. 9 as explained above are relay switches. However, they can be other switches such as transistor switches.

As described above, either of the developing devices can prevent leaks or discharge phenomenon from occurring between the charge erasing member 9 and the developing sleeve 2 and safely achieve erasure of the charge of residual toner. When erasure of the charge of residual toner can be achieved, the residual toner can be easily removed from the developing sleeve 2 in the buffer chamber 5. Therefore, the transport quantity of the toner to the developing region and the charge of that toner can be maintained at an optimum level. Furthermore, poor conditions such as toner accumulation on the developing sleeve 2, toner deterioration and toner filming can be controlled to obtain an excellent image without toner adhering to the non-image portion or toner scattering.

Moreover, although the embodiment described above uses a flexible developing sleeve as the developing agent carrier, another form of a developing device which uses a developing sleeve without flexibility or a developing roller formed by an elastic member can be applied to this invention. Although the toner used in the embodiment described above has a negative electric charge, toner with a positive electric charge can also be used with this invention.

Although the present invention has been fully described by way of examples with reference to the accompanying drawings, it is to be noted that various changes and modifications will be apparent to those skilled in the art.

Therefore, unless otherwise such changes and modifications depart from the scope of the present invention, they should be construed as being included therein.

What is claimed is:

1. An image forming apparatus comprising:

an electrostatic latent image carrier;

an image forming means for forming an electrostatic latent image on said electrostatic latent image carrier;

a developing device including a toner carrying member opposed to said electrostatic latent image carrier and having a movable surface on which a toner is held;

a charge erasing member being in contact with said surface of said toner carrying member;

a developing bias power unit which applies a developing bias voltage to said toner carrying member;

a charge erasing bias power unit which applies a charge erasing bias voltage to said charge erasing member; and a control circuit for controlling the charge erasing bias voltage in response to a state of said image forming means.

2. The image forming apparatus as claimed in claim 1, wherein said image forming means includes an operating state where said image forming means forms an image on electrostatic latent image carrier and an idle sate where said image forming means stops forming an image on electrostatic latent image carrier, and said control circuit controls said charge erasing bias power unit such that said charge erasing bias voltage is applied to said charge erasing member only when said image forming means is said idle state.

3. The image forming apparatus as claimed in claim 1, wherein said image forming means includes an operating state where said image forming means forms an image on electrostatic latent image carrier and an idle sate where said image forming means stops forming an image on electrostatic latent image carrier, and said control circuit controls said charge erasing bias power unit such that a first electric potential of said charge erasing bias voltage is applied to said charge erasing member when said image forming means is said idle state, while said control circuit controls said charge erasing bias power unit such that a second electric potential of said charge erasing bias voltage is applied to said charge erasing member when said image forming means is said operating state.

4. The image forming apparatus as claimed in claim 3, wherein control circuit controls said charge erasing bias power unit such that a first electric potential difference between said second electric potential of said charge erasing bias voltage and said developing bias voltage being smaller than a second electric potential difference between said first electric potential of said charge erasing bias voltage and said developing bias voltage.

5. The image forming apparatus as claimed in claim 1, wherein said image forming means includes an exposing device which exposes a surface of said electrostatic latent image carrier to form an electrostatic latent image thereon.

6. The image forming apparatus as claimed in claim 5, wherein said control circuit controls said charge erasing bias power unit such that said charge erasing bias voltage is applied to the charge erasing member only when said exposing device is turned off.

7. The image forming apparatus as claimed in claim 1, wherein said developing device includes an operating state where said developing device supplies a toner to the electrostatic latent image carrier and an idle state where said developing device stops supplies a toner to the electrostatic latent image carrier; and said control circuit controls said charge erasing bias power unit such that said charge erasing bias voltage is applied to said charge erasing member only when said developing device is said idle state.

8. The image forming apparatus as claimed in claim 1, wherein said image forming means includes an operating state where said image forming means forms an image on electrostatic latent image carrier and an idle sate where said image forming means stops forming an image on electrostatic latent image carrier, and further comprising:

a switching member provided between the charge erasing member and the charge erasing bias power unit;

said switching member connecting the charge erasing member to the charge erasing bias power unit when said image forming means is said idle state; and said switching member opening when said image forming means is said operating state.

9. The image forming apparatus as claimed in claim 1, wherein said image forming means includes an operating state where said image forming means forms an image on electrostatic latent image carrier and an idle sate where said image forming means stops forming an image on electrostatic latent image carrier, and further comprising:

a switching member provided between the charge erasing member and the charge erasing bias power unit;

said switching member connecting the charge erasing member to the charge erasing bias power unit when said image forming means is said idle state; and said switching member connecting the charge erasing member to the developing bias power unit when said image forming means is said operating state.

10. The image forming apparatus as claimed in claim 1, wherein said image forming means includes an operating state where said image forming means forms an image on electrostatic latent image carrier and an idle sate where said image forming means stops forming an image on electrostatic latent image carrier, and further comprising:

said charge erasing bias power unit including a first portion which applies said charge erasing bias voltage having a first electric potential and a second portion which applies said charge erasing bias voltage having a second electric potential;

a switching member provided between the charge erasing member and the charge erasing bias power unit;

said switching member connecting the charge erasing member to a first said first portion when said image forming means is said idle state; and said switching member connecting the charge erasing member to said second portion when said image forming means is said operating state.

11. The image forming apparatus as claimed in claim 1, wherein said image forming means forms a plurality of electrostatic latent image intermittently, and said control circuit controls said charge erasing bias power unit such that the charge erasing bias voltage is applied during image formations while being stopped during the intervals of the image formations.

12. The image forming apparatus as claimed in claim 1, wherein an absolute value of said charge erasing bias voltage is smaller than an absolute value of said developing bias voltage.

13. The image forming apparatus as claimed in claim 1, further comprising a toner restricting member pressing in contact with the surface of said toner carrying member.

14. The image forming apparatus as claimed in claim 13, wherein said toner restricting member is located at an upstream side from said developing region with respect to a moving direction of said surface of said toner carrying member.

15. The image forming apparatus as claimed in claim 14, wherein a toner restricting bias voltage is applied to said toner restricting member, an absolute value of charge erasing bias voltage is smaller than an absolute value of developing bias voltage and an absolute value of developing bias voltage is smaller than an absolute value of toner restricting bias voltage.

16. The image forming apparatus as claimed in claim 1, wherein said charge erasing member is located at a downstream side from said developing region with respect to a moving direction of said surface of said toner carrying member.

17. The image forming apparatus as claimed in claim 1, wherein said toner carrying member includes a thin film that is loosely mounted around a rotatable drive roller, a peripheral length of the film is slightly longer than a peripheral length of said drive roller.

18. An image forming apparatus comprising:

an electrostatic latent image carrier;

an image forming means for forming an electrostatic latent image on said electrostatic latent image carrier;

a developing device including a toner carrying member opposed to said electrostatic latent image carrier and having a movable surface on which a toner is held;

a charge erasing member being in contact with said surface of said toner carrying member;

a developing bias power unit which applies a developing bias voltage to said toner carrying member;

a connection circuit which connects said developing bias power unit with said charge erasing member, while said connection circuit applies a charge erasing bias voltage to said charge erasing member, and a control circuit for controlling said charge erasing bias voltage in response to a state of said image forming means.

19. The image forming apparatus as claimed in claim 18, further comprising:

a toner restricting member pressing in contact with the surface of said toner carrying member, and wherein said connection circuit connects said developing bias power unit with said toner restricting member, said developing bias power unit with said toner carrying member through a first Zener diode, and said developing bias power unit with said charge erasing member through said first Zener diode and a second Zener diode.

20. A method performed in an image forming apparatus comprising an electrostatic latent image carrier, a developing device having a toner carrying member opposed to said electrostatic latent image carrier and having a movable surface on which a toner is held, and a charge erasing member, said method comprising the steps of:

forming an electrostatic latent image on said electrostatic latent image carrier;

developing said electrostatic latent image on said electrostatic latent image carrier by said developing device;

applying a charge erasing bias voltage to said charge erasing member; and changing a potential of said charge erasing bias voltage in response to a state of said image forming.

* * * * *